US005352872A

United States Patent [19]

Tsuji et al.

[11] Patent Number: 5,352,872

[45] Date of Patent: Oct. 4, 1994

[54] SYSTEM OF SUPPLYING ELECTRIC POWER TO INDUCTION FURNACE

[75] Inventors: Sadao Tsuji, Tokyo; Takayuki Hira; Shizuo Hayashi, both of Kanagawa, all of Japan

[73] Assignee: Fuji Electric Co., Ltd., Kanagawa, Japan

[21] Appl. No.: 24,289

[22] Filed: Mar. 1, 1993

[30] Foreign Application Priority Data

Apr. 24, 1992 [JP] Japan ..... 4-105011

[51] Int. Cl.[5] ..... H05B 6/06

[52] U.S. Cl. ..... 219/660; 219/663; 219/669; 373/148

[58] Field of Search ..... 219/10.77, 10.75, 660, 219/611, 663, 664, 665, 666, 669, 670; 373/147, 148, 149, 150

[56] References Cited

U.S. PATENT DOCUMENTS

| | | | |
|---|---|---|---|
| 2,545,296 | 3/1951 | Mittelmann | 219/10.77 |
| 2,813,186 | 11/1957 | Bock | 219/10.77 |
| 2,868,902 | 1/1959 | Mika et al. | 219/10.77 |
| 2,945,112 | 7/1960 | Scott | 219/10.77 |

FOREIGN PATENT DOCUMENTS 269371 4/1927 United Kingdom .

OTHER PUBLICATIONS

British Search Report dated Apr. 20, 1993.

*Primary Examiner*—Philip H. Leung

*Attorney, Agent, or Firm*—Finnegan, Henderson Farabow, Garrett & Dunner

[57] ABSTRACT

In a system of supplying electric power to an induction furnace, a required heating power is directly supplied to the induction furnace from an ac synchronous generator driven by a prime mover, such as a diesel engine, via a single-phase coil. At the same time, the voltage to be supplied to the single-phase coil is rendered continuously variable by an automatic voltage regulator of the generator to render continuously variable the heating power corresponding to the voltage to be supplied, and the frequency of the voltage to be supplied is rendered continuously variable by an automatic frequency regulator of the prime mover in accordance with predetermined mutual relationships with the voltage to be supplied. In addition, at the start of power supply, the voltage to be supplied and the frequency thereof are increased with gradients for a predetermined time duration from their predetermined minimum values to their rated values in accordance with the predetermined mutual relationships.

6 Claims, 4 Drawing Sheets

SYSTEM OF SUPPLYING ELECTRIC POWER TO INDUCTION FURNACE

BACKGROUND OF THE INVENTION

1. Field of the Invention

The present invention relates to a system of supplying electric power to an induction furnace-provided with an ac generating apparatus that constitutes an exclusive-use power source, independent of a commercial power source, such as an ac power source for an induction furnace (or an induction heater), to which required heating electric power is supplied via its single-phase coil and which serves as a single-phase load with respect to its ac power source. An output voltage and frequency of the ac generating apparatus is continuously variably controlled.

2. Description of Conventional Art

FIGS. 4–6 show conventional induction-furnace power-supplying systems of this type. In such conventional systems, required heating power is supplied to the induction furnace.

For example, the system shown in FIG. 4 uses a commercial power source as a basic power source, and uses, an ac generator driven by a prime mover, such as a diesel engine, as a complementary power source for the commercial power source. The system shown in FIG. 5 uses the commercial power source as an exclusive-use power source. Because the system causes a motor generating apparatus driven by the commercial power source to function as a frequency converter, it serves as a required heating power source and is generally used for a high-frequency furnace. In addition, the system shown in FIG. 6 uses an ac generator driven by a prime mover, such as the one described below, as the exclusive-use power source. The system, change in the required supply voltage is effected by a changeover of a tap of a transformer mounted in a power-supplying main circuit. The frequency of the supply voltage is usually made identical to the commercial frequency. Alternatively an output of the ac generator is rectified and is then converted to an alternating current having a required voltage and frequency by an inverter to supply power.

In the following description of FIGS. 4 to 6, component elements having the same functions in the drawings are denoted by the same reference numerals or characters.

First, in FIGS. 4A and 4B, $G_3$ denotes a three-phase ac generator. E denotes a prime mover such as a diesel engine for driving the generator. $CB_{S1}$ and $CB_{S2}$ denote power source-side circuit breakers. $CB_{L1}$ to $CB_{Ln}$ (n=1, 2, . . . ), denote load-side circuit breakers. Numeral 10 denotes induction furnace facilities constituted by an induction furnace and its incidental equipment. COS in FIG. 4B denotes a changeover switch for separating the power-supplying main circuit between the commercial power source and the three-phase ac generator.

Namely, FIG. 4A shows a basic circuit configuration in which the Circuit is arranged to enable a generating apparatus, constituted by the prime mover E and the three-phase ac generator $G_3$, to operate in parallel with the commercial power source, and which is used for peak cutting when maximum receiving power from the commercial source is restricted. Meanwhile, FIG. 4B shows a basic circuit configuration in which the generating apparatus is operated as an emergency power source for supplying power to the induction furnace facilities separated from the commercial power source by the changeover switch COS during a power failure of the commercial power source. In either FIG. 4A or FIG. 4B the generating apparatus is used as a complementary power source for the commercial power source.

Accordingly, with regard to the generating apparatus, its output frequency is identical to that of the commercial power supply, and in FIG. 4A its output capacity is set to be less than the difference between the required maximum power for the overall loads, including the induction furnace facilities 10, and the maximum contract power. Meanwhile, in FIG. 4B, the output capacity of the generating apparatus is determined, as required, by setting as its minimum value the sum of various power required for continuing the operation of the induction furnace in a heat-retained condition. In either case, the output capacity of the generating apparatus is set to be a value smaller than the aggregate total of the rated power of the aforementioned loads.

Next, in FIG. 5, M denotes an ac motor. $G_1$ denotes a high-frequency single-phase ac generator driven by the motor. $T_{R1}$ denotes a transformer. Numeral 7 denotes a single-phase coil for applying heating power mounted on the body of the induction furnace; $C_P$ denotes a power-factor improving capacitor for the single-phase coil. and Numeral 11 denotes induction furnace facilities in which the aforementioned single-phase coil and the aforementioned various power-supplying incidental elements are grouped together.

Namely, FIG. 5 shows an induction furnace power-supplying system that uses the commercial power source as its exclusive-use power source, and which is generally used for a high-frequency induction furnace. The motor M and the generator $G_1$ together constitute a motor-generator that functions as a frequency converter with respect to a power-supply input from the commercial power source. It should be noted that the output voltage and the output frequency of the motor generator are rendered variable by adjustment of the energization of the generator $G_1$ and adjustment of the number of revolutions of the motor M, respectively. In addition, the output capacity of the motor generator is determined as a value capable of supplying the required maximum power of the induction furnace.

In FIG. 6A, $SW_1$ and $SW_2$ denote switches of electromagnetic contactors or the like, respectively. CLR denotes a current-limiting resistor; $T_{R2}$ denotes a tapped transformer. $C_B$ and $L_B$ denote a capacitor and a reactor, respectively, for phase balancing. 12 denotes induction furnace facilities in which the aforementioned single-phase coil 7 and the aforementioned various power-supplying incidental elements are grouped together.

Namely, FIG. 6A shows a basic circuit configuration of a power-supplying system for a low-frequency induction furnace that uses a generating apparatus constituted by the prime mover E and the three-phase ac generator $G_3$ as its exclusive-use power source, and whose frequency is generally set to the 50/60 Hz of the commercial frequency.

It should be noted that the capacitor $C_P$ for improving the power factor is simply connected in parallel with the single-phase coil 7 and is designed to set the combined power factor of the two elements to 1 or a value close thereto and to allow the synthetic characteristic to serve as a resistance element. The parallel connection between the single-phase coil 7 and the capacitor $C_P$, which are thus arranged like a resistance element, together with the phase-balancing capacitor $C_B$ and reactor $L_B$, constitutes a phase-balancing Grebor circuit for balancing the loads of the power sources-side phases when power is supplied from the three-phase power source to the single-phase resistance load. In addition, when the resistance portion and the power factor of the aforementioned single-phase coil itself have changed in correspondence with the state of load of the aforementioned induction furnace, to balance the load among the phases on three-phase power source side as described above, the respective values of the elements of $C_P$, $C_B$, and $L_B$ are changed and controlled in association with a predetermined relationship through control of the opening and closing of a switch which operates in response to a command of an unillustrated power-factor and phase-balancing controller.

In addition, required heating power for the induction furnace, which is inputted via the single-phase coil 7, changes substantially in correspondence with the condition of operation of the induction furnace, such as heating, melting, and heat retention. The voltage to be applied to the aforementioned single-phase coil is changed and controlled by changing the taps of the transformer $T_{R2}$ in accordance with a change of such required power, and the variable range of voltage reaches, for instance, approximately 20 to 100% of the rated voltage.

In addition, to control a transient overcurrent of the main circuit during the changing of the transformer taps, the insertion of the current-limiting resistor CLR into the main circuit by closing the switch $SW_2$ with the switch $SW_1$ open, the short-circuiting of that current-limiting resistor by closing the $SW_1$ after completion of the state of the transient overcurrent of the main circuit current, and the setting of the current-limiting resistor in a parallel-off state by subsequently opening the $SW_2$, are effected in a predetermined order.

Next, in FIG. 6B, $T_{R3}$ denotes a transformer for a rectifier. REC denotes a rectifier circuit that is comprised of a plurality of rectifier elements respectively subjected to phase control, and which renders an output dc voltage thereof continuously variable. DCL denotes a dc rector for smoothing. INV denotes an inverter serving as a frequency converter. $T_{R4}$ denotes a matching transformer. $C_P$ denotes a power-factor improving capacitor for the single-phase coil. Numeral 13 denotes induction furnace facilities in which the aforementioned single-phase coil 7 and the aforementioned various power-supplying incidental elements are grouped together.

Namely, FIG. 6B shows a power-supplying system which uses a generating apparatus constituted by the prime mover E and the three-phase ac generator $G_3$ as its exclusive-use power source, and in which power supplied to the induction furnace is rendered continuously variable via a voltage transforming circuit and a frequency converting circuit whose outputs are respectively continuously variable. The power-supplying system of this type is generally used for high-frequency induction furnaces.

It should be noted that, in terms of its configuration, the power-supplying system shown in FIG. 6B is equivalent to a configuration in which the motor generating apparatus comprised of the motor M and the high-frequency single-phase ac generator $G_1$ in FIG. 5 is substituted by a voltage/frequency converting circuit of a stationary type having a wider range of variable output. The supply voltage may be either three phase or single phase.

The variable range of required heating power of the induction furnace is generally required to be very extensive in the light of the diversity of its operating condition. Therefore, it is desirable that the voltage and frequency of electric power supplied to the induction furnace be controlled so as to be continuously and smoothly variable in an extensive range.

However, the various conventional induction-furnace power-supplying systems such as those described above have presented the several problems.

First, with respect to the power-supplying systems shown in FIGS. 4A and 4B, the subject induction furnaces are restricted to a low-frequency furnace to which the commercial frequency is applied. In addition, as a problem similar to that in the power-supplying system shown in FIG. 6A, if the configuration of the induction furnaces facilities 10 shown in FIGS. 4A and 4B are similar to the induction furnace facilities 12 in FIG. 6A, the change of heating power for the induction furnace is effected in stages by the changing of the taps of the transformer $T_{R2}$, so that an amount of minimum change of the heating power naturally had to be restricted.

In addition, the induction furnace serves as a single-phase load with respect to its power source, and in a case where the power source is a three-phase ac power source, the provision of a phase balancing means becomes necessary to suppress the generation of a negative-phase-sequence component resulting from an interphase load unbalance due to the supply of power to the single-phase load. For this reason, the following become necessary: the power-factor improving capacitor $C_P$ of a large capacity for correcting the lagging power factor of the single-phase coil 7 of a low power factor; the capacitor $C_B$ and the reactor $L_B$ for phase balancing; a multiplicity of switches and a switch controller for the switches so as to render the aforementioned elements $C_P$, $C_B$, and $L_B$ continuously variable in accordance with a predetermined relationship, these elements being, in reality, arranged in step-like combinations of their unit amounts, respectively, in response to the condition of operation of the induction furnace. Hence, the configuration of the power-supplying system has been complex and large in size.

Furthermore, since the transformer $T_{R2}$ opens and closes of the main circuit for transforming the supply voltage in the power-supplying system having the large-capacity capacitors such as $C_P$ and $C_B$, the rush current into the main circuit during the closing of the main circuit in a state in which no measure is taken becomes excessively large, i.e., 15 to 18 times as large as the rated current thereof. Hence, to control that overcurrent, it is necessary to provide an overcurrent controlling means comprised of the switches $SW_1$ and $SW_2$, the current-limiting resistor CLR, and the like shown in FIG. 6A. At the same time, with respect to the capacity of the three-phase ac generator $G_3$, in order to reduce a voltage drop due to the overcurrent after control and to absorb a negative-phase-sequence component due to the residual component of the interphase load unbalance, a value which is, for instance, 1.5 times the capacity corresponding to its required load capacity must be set as its rated capacity. Consequently, the ac generator becomes large in size, and the configuration of the power-supplying system is made more complex.

Next, with respect to the power-supplying system shown in FIG. 5, since the single-phase ac generator $G_1$ is used for the induction furnace, which is a single-phase load, the configuration of the power-supplying system is quite simplified, but the size of that generator becomes very large as compared with the three-phase ac generator of the same capacity. Hence, a generator having a capacity capable of supplying the required maximum power for the induction furnace is bound to be very uneconomical. In addition, the power-supplying system basically uses the aforementioned commercial power source as an exclusive-use power source. Thus, its operation has been bound to be impossible during a power failure of the commercial power source.

Thus, although the power-supplying system shown in FIG. 6B is sophisticated, the system configuration is also complicated. In addition, to prevent the efflux of harmonics generated from each stationary-type converter to the power source side, it is necessary to dispose an unillustrated harmonic filter at an effective position such as at an input terminal of the induction furnace facilities 13. Also, with the three-phase ac generator $G_3$, it is necessary to increase its capacity to such a degree that permits the absorption of the equivalent negative-phase-sequence component due to the aforementioned harmonics with respect to the required load capacity. Hence, it has been unavoidable that conventional systems are larger in size.

As described above, in the respective conventional systems for supplying electric power to an induction furnace, there have been no systems that optimally combine size, required installation space, price, and the like in terms of their functions and the configuration of the power-supplying system.

SUMMARY OF THE INVENTION

In view of the foregoing description, it is an object of the present invention to provide a system of supplying electric power to an induction furnace which makes it possible to simplify and, reduce the cost of, the configuration of the power-supplying system by using as an exclusive-use power source a generating apparatus in which an ac generator is driven by means of a diesel engine or the like used as a prime mover by way of the power-supplying system for the induction furnace, and which makes it possible to strengthen the facilities without an accompanying increase in contract power on the part of the user.

To attain the aforementioned object, the system of supplying electric power to an induction furnace in accordance with the present invention is a system of supplying electric power to an induction furnace for supplying required heating power to a metal to be heated in a body of the induction furnace via a single-phase coil mounted in the body of the induction furnace, wherein a generating apparatus comprised of a prime mover such as a diesel engine and an ac generator driven by the prime mover is used as an exclusive-use power source independent from a commercial power source, and an ac voltage having a predetermined voltage and a frequency corresponding to the heating power is directly supplied to the single-phase coil. At the same time, the voltage to be supplied to the single-phase coil is rendered continuously variable by a voltage regulator for the ac generator, and the frequency of the voltage to be supplied is rendered continuously variable by a speed regulator for the prime mover. Also, the voltage to be supplied and a frequency thereof are rendered continuously variable by the voltage regulator and the speed regulator in accordance with predetermined mutual relationships. In addition, at the start of supply of power to the single-phase coil, the voltage to be supplied and the frequency thereof are increased with gradients for a predetermined time duration from their predetermined minimum values to their rated values in accordance with the predetermined mutual relationships. Furthermore, in a case where the ac generator is a three-phase generator, an mount of negative-phase resistance of the generator is made a value corresponding to a state of maximum load unbalance in controlling the phases of the three phases.

As described above, in the operation of an induction furnace, appropriate control of the changing of the voltage to be supply and the frequency thereof is needed for changing the power to be supplied in correspondence with the operation condition.

In meeting this requirement, the conventional induction-furnace power-supplying systems described above, in both cases where a commercial power source is used as the power source for supplying power to the induction furnace and where a generating apparatus in which an ac generator is driven by a prime mover such as diesel engine is used as the same, various voltage transforming means and frequency converting means are provided by assuming that the power source-side voltage and the frequency thereof are both fixed to be the commercial voltage and the commercial frequency. Thus, the provision of these two means has resulted in various problems.

In the present invention, the above-described generating apparatus of prime mover drive is installed for exclusive use as the power source for supplying power to the induction furnace, and the voltage to be supplied and the frequency thereof are respectively rendered continuously variable on the generating apparatus side through adjustment of energization of the ac generator and adjustment of the rotational speed of the prime mover. Accordingly, the voltage transforming means and the frequency converting means in the conventional induction-furnace power-supplying systems are made unnecessary. At the same time, the installation of a harmonic filter for preventing the efflux of harmonics to the outside is made unnecessary.

PREFERRED EMBODIMENTS OF THE PRESENT INVENTION

Figure 3:
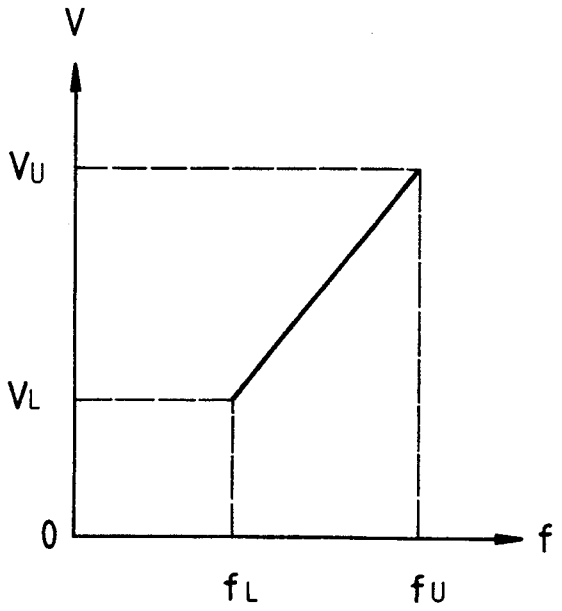
FIG. 3 is a diagram of an output-voltage with respect to an output frequency characteristic of an ac generator.
Figure 5:
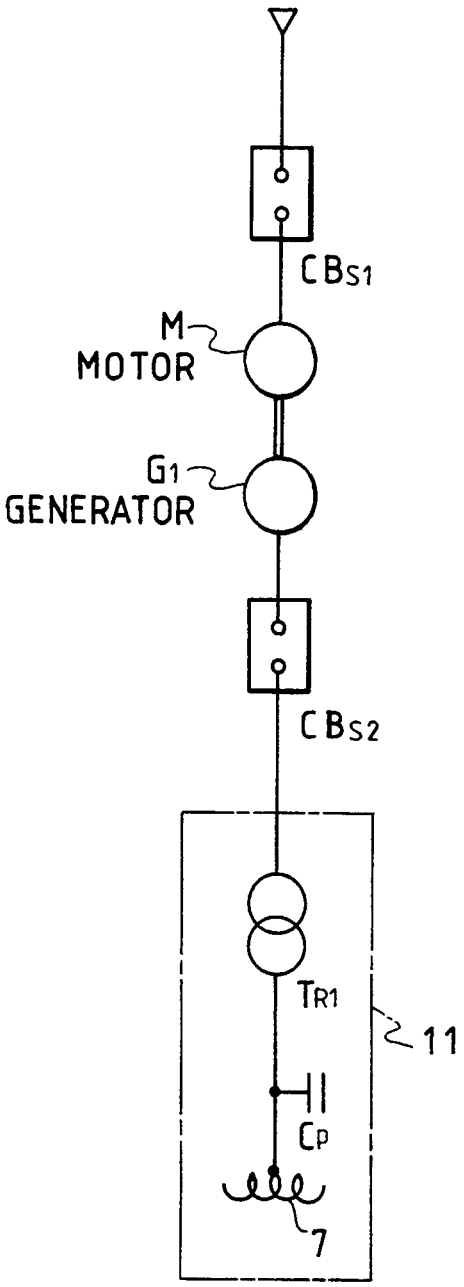
FIG. 5 is a diagram of a conventional system supplying electric power to an induction furnace.
Figure 4A:
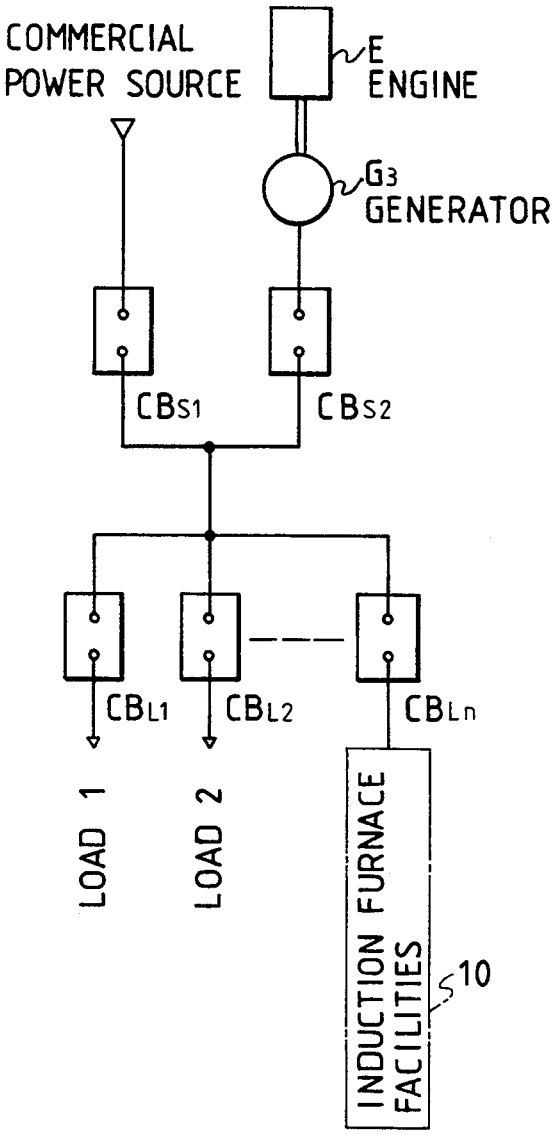
FIGS. 4A and 4B are diagrams of a conventional system supplying electric power to an induction furnace.
Figure 4B:
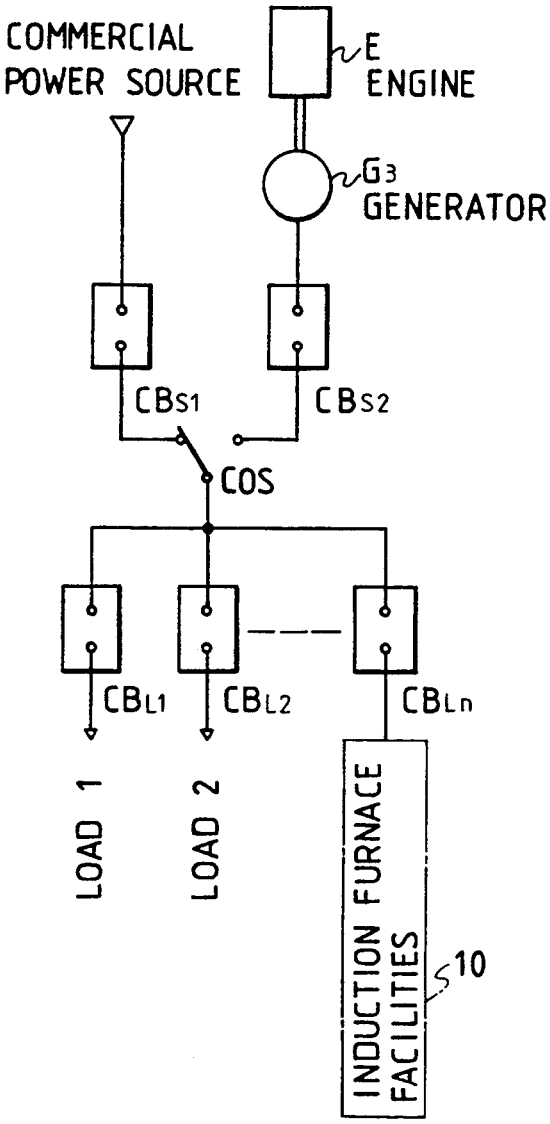
Figure 6A:
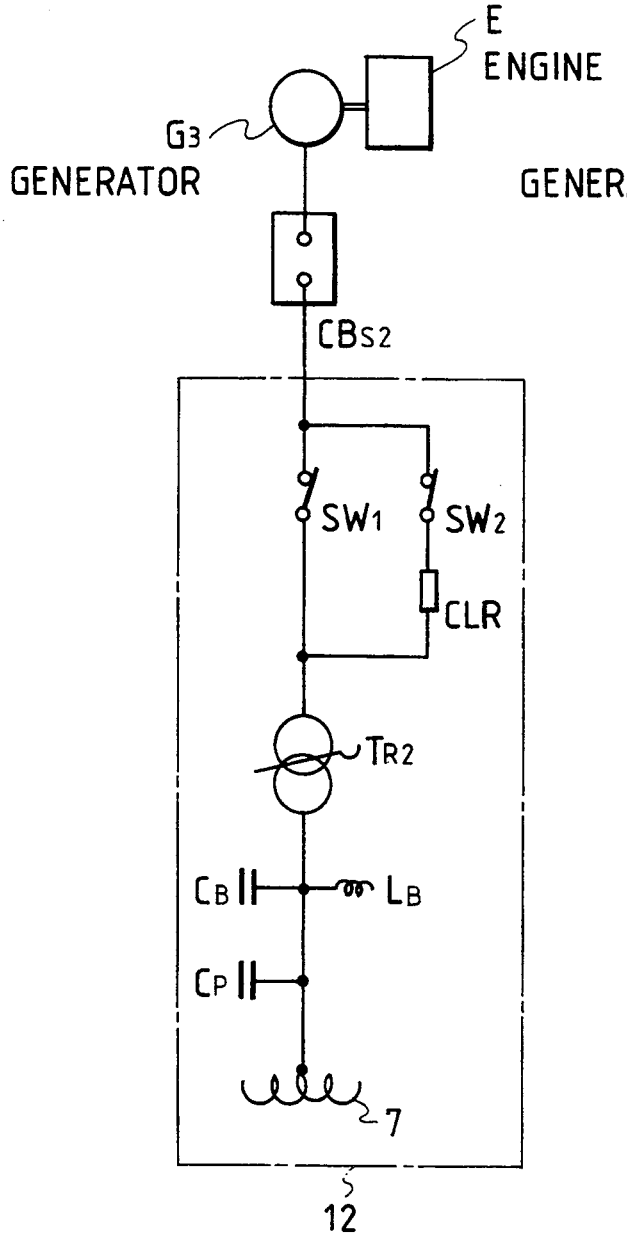
FIGS. 6A and 6B are diagrams of conventional system supplying electric power to an induction furnace.
Figure 6B:
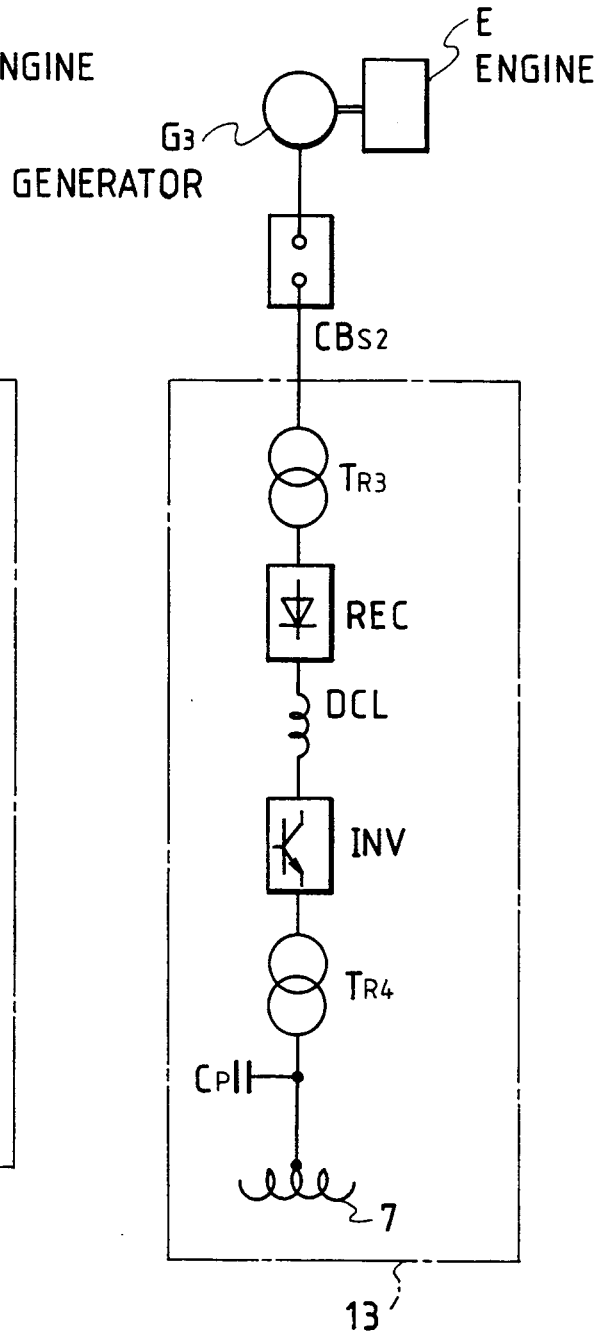

Hereafter, a description will be given of a first and a second embodiment of the present invention with reference to power-supplying system diagrams respectively illustrated in FIGS. 1 and 2. In addition, FIG. 3 illustrates a diagram of an output-voltage with respect to output frequency characteristic of an ac generator in the aforementioned generating apparatus. It should be noted that, in both FIGS. 1 and 2, component elements having identical functions to those of the drawings of FIGS. 4 to 6 illustrating conventional systems will be denoted by the same reference characters.

Figure 1:
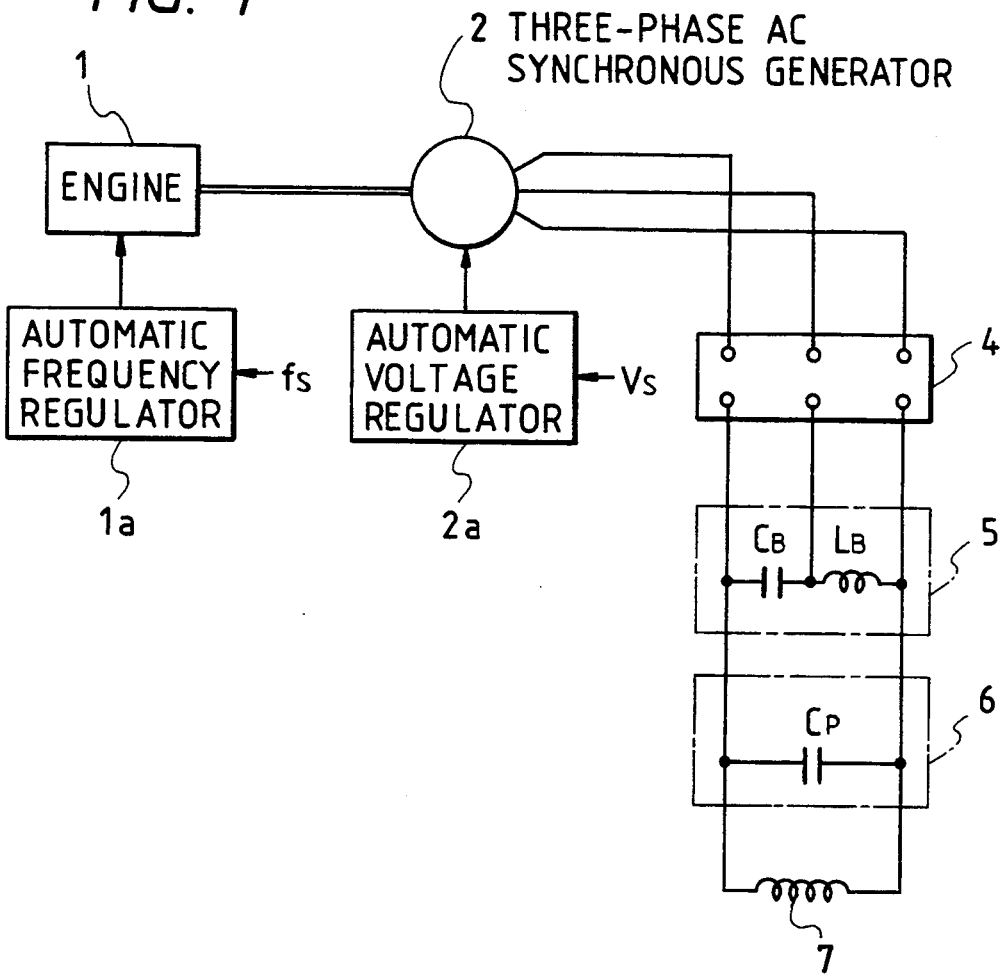
FIG. 1 is a diagram of a system of supplying electric power to an induction furnace which illustrates a first embodiment of the present invention.

FIG. 1 shows a prime mover 1 such as a diesel engine; a three-phase ac synchronous generator 2 driven by the prime mover 1; an automatic frequency regulator 1*a* for automatically regulating the rotational speed of the prime mover 1 which is in a particular relationship with an output frequency f of the generator, in accordance with a set value $f_s$ of that output frequency; an automatic voltage regulator 2*a* for automatically regulating an output voltage V of the aforementioned generator 2 in accordance with its set value $V_s$ through adjustment of the energization of the generator 2; a circuit breaker 4; a phase balancer 5 including a capacitor $C_B$ and a reactor $L_B$ both for phase balancing and a plurality of unillustrated switches for changing the capacities of the two elements $C_B$ and $L_B$, and so on; a single-phase coil 7 for inputting heating power mounted on the body of the induction furnace; and a power-factor adjusting device 6 including a capacitor $C_P$ for improving the power factor of that single-phase coil as well as a plurality of unillustrated switches for changing its capacity, and so on.

It should be noted that the combined power factor through the parallel connection of the capacitor CP and the single-phase coil 7 is constantly controlled to 1 or thereabouts by the power-factor regulator irrespective of fluctuations in the power factor of the single-phase coil itself responsive to changes of the operating condition of the induction furnace, so that the resultant characteristic of the parallel connection is made to function as an equivalent resistor. Hence, a three-phase-load balancing Grebor circuit, such as the one described above, is formed by the three elements including the aforementioned parallel connection, which is set in the state of an equivalent resistor, and the elements $C_B$ and $L_B$, whose values are determined in a predetermined relationship with an equivalent resistance value of the parallel connection.

As shown in FIG. 1, the voltage of power supplied to the single-phase coil 7 and its frequency, which are determined in correspondence with the required heating power of the induction furnace, are continuously regulated on the generating apparatus side serving as a power source for the induction furnace by means of the aforementioned automatic voltage regulator 2*a* and automatic frequency regulator 1*a*. Accordingly, the operation of changing the transformer taps for changing the supply voltage in the prior art becomes unnecessary, and the occurrence of the state of the overcurrent of the main circuit resulting from the tap-changing operation can be avoided. Hence, the induction-furnace heating power can be changed smoothly. In addition, the voltage transforming means constituted by the transformer, its tap-changing operation circuit and the like, as well as the frequency converting means become unnecessary, and the size of the ac generator can be reduced. Hence, it is possible to substantially simplify and, reduce the size and configuration of the induction-furnace power-supplying system.

Figure 2:
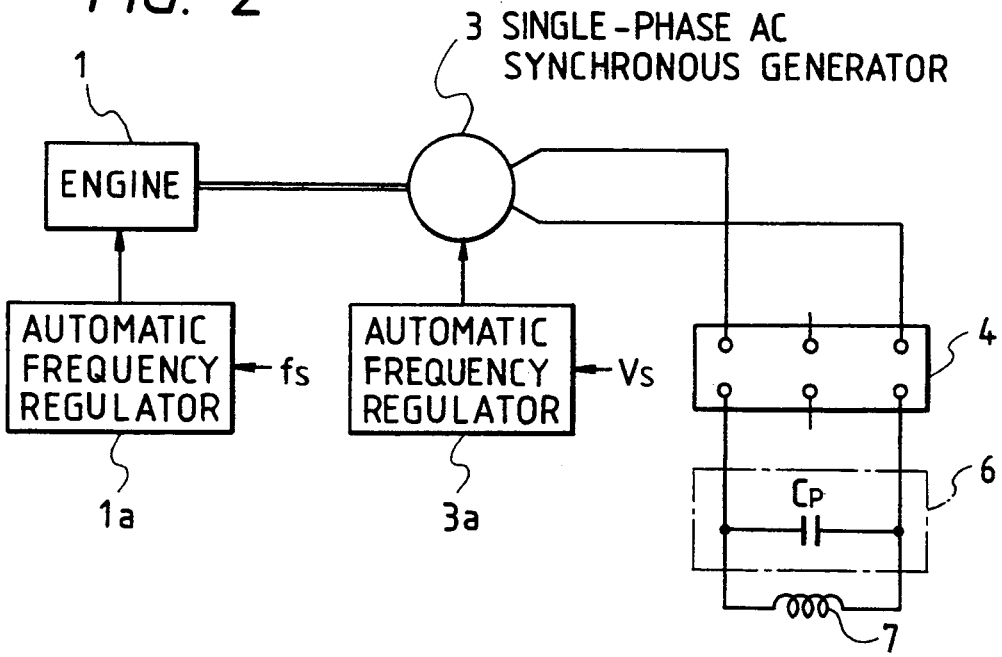
FIG. 2 is a diagram a system of supplying electric power to an induction furnace which illustrates a second embodiment of the present invention.

Next, in FIG. 2, the three-phase ac synchronous generator 2 and its automatic voltage regulator 2*a* in FIG. 1 are changed to a single-phase ac synchronous generator 3 and its automatic voltage regulator 3*a*. The phase balancer 5 which becomes unnecessary as a result of this change is omitted. The characteristic of the induction-furnace power-supplying system as compared with conventional systems becomes similar to that of the three-phase power-supplying system shown in FIG. 1.

Furthermore, the diagram of the output voltage with respect to output frequency characteristic of the ac generator shown in FIG. 3 illustrates the operable range of the ac generator in FIG. 1 or 2, and is suitable to the required operational range of the induction furnace. Namely, it is assumed that the variable range of voltage is set in a range between a maximum voltage $V_U$ and a minimum voltage $V_L$, that the variable range of the frequency is set in a range between a maximum frequency $f_U$ and a minimum frequency $f_L$, and that a V/f ratio constant characteristic is imparted as a standard. Accordingly, the region surrounded by the respective points ($f_L$, 0), ($f_L$, $V_L$), ($f_U$, $V_U$), and ($f_U$, 0) becomes the operable range of the ac generator. It should be noted that the aforementioned variable range of the frequency serves to control the operation of the prime mover as the variable range of the number of revolutions of the prime mover which corresponds to that frequency.

In addition, the ratings of the aforementioned ac generator and prime mover are selected in such a manner as to be optimally suitable to the operable range surrounded by the aforementioned four points. Accordingly, in a case where the operation is conducted outside that operable range, it is necessary to provide leeway in terms of the ratings in correspondence with the operational condition.

In accordance with the present invention, in a system of supplying electric power to an induction furnace for supplying required heating power to a metal to be heated in a body of the induction furnace via a single-phase coil mounted in the body of the induction furnace, the generating apparatus in which the ac generator is driven by the prime mover, such as the diesel engine, is used as an exclusive-use power source independent to directly supply the required heating power to said single-phase coil. In addition, the power to be supplied to the single-phase coil and the frequency thereof are rendered continuously variable in accordance with predetermined mutual relationships, or at the start of supply of power to said single-phase coil the voltage to be supplied and the frequency thereof are increased with gradients for a predetermined time duration from their predetermined minimum values to their rated values in accordance with the predetermined mutual relationships. Thus, the voltage to be supplied and the frequency thereof are continuously controlled on the generating apparatus side in correspondence with the operating condition of the induction furnace. Accordingly, the voltage transforming means, such as the tapped transformer and its accessories, and the frequency converting means, such as an inverter or a motor generator, are made unnecessary, thereby making it possible to substantially simplify and, reduce the size of, the configuration of the induction-furnace power-supplying system. This simplification and reduction results substantial reduction of the required installation space and lowers the price of the required apparatus as a whole. Meanwhile, it becomes possible to smoothly change the required power for the induction furnace through the continuous adjustment of the supply voltage as described above. Furthermore, the occurrence of a transient state of overcurrent of the main circuit due to the changing in steps of the supply voltage in the conventional power-supplying systems is completely avoided, thereby making it possible to improve safety and smoothness in the operation of the induction furnace. Furthermore, because the aforementioned generating apparatus is separated from the commercial power source and is used as an exclusive power source for the induction furnace, it is possible to strengthen the facilities without an accompanying increase in contract power on the part of the user and to enhance the degree of freedom in the installation of the induction furnace facilities.

What is claimed is:

1. A system of ac electric power supply to an induction furnace for supplying a required heating power to a metal to be heated in the induction furnace, said system comprising:

a single-phase coil mounted in the induction furnace in a location near the metal to be heated;

a generating apparatus, including a prime mover having a rotating portion and an ac generator driven by said prime mover, for generating said ac electric power, said ac electric power generated by the generating apparatus having a predetermined voltage and a frequency corresponding to the required heating power, and said ac electric power being directly supplied to said single-phase coil, wherein said generating apparatus is used as a sole power source for the system;

a speed regulator connected to said prime mover for regulating a frequency of a voltage to be supplied to said single-phase coil so that the voltage is continuously variable, to directly control a rotation of the prime mover.

2. A system supplying electric power to an induction furnace in accordance with claim 1 further comprising a voltage regulator connected to said ac generator for regulating the ac voltage to be supplied to said single-phase coil so that the voltage is continuously variable.

3. A system of electric power supply to an induction furnace in accordance with claim 1 further comprising:

a voltage regulator connected to said ac generator for regulating the ac voltage to be supplied to said single-phase coil so that the voltage is continuously variable, wherein the voltage to be supplied to said single-phase coil and a frequency thereof are rendered continuously variable by said voltage regulator and said speed regulator in accordance with predetermined mutual relationships.

4. A system of electric power supply to an induction furnace in accordance with claim 3, wherein at a start of supply or power to said single-phase coil the voltage to be supplied and the frequency thereof are increased with gradients for a predetermined time duration from their predetermined minimum values to their rated values in accordance with the predetermined mutual relationships.

5. A system of electric power supply to an induction furnace in accordance with claim 1, wherein when said ac generator is a three-phase generator, an amount of negative-phase resistance of said generator is a value corresponding to a state of maximum load unbalance in controlling the phases of the three phases.

6. A system of electric power supply to an induction furnace as claimed in claim 1, wherein said prime mover is an internal combustion engine.

* * * * *

UNITED STATES PATENT AND TRADEMARK OFFICE

CERTIFICATE OF CORRECTION

PATENT NO. : 5,352,872

DATED : October 04, 1994

INVENTOR(S) : Sadao TSUJI et al.

It is certified that error appears in the above-indentified patent and that said Letters Patent is hereby corrected as shown below:

On the title page:
Attorney, Agent, or Firm, Front Page after "Henderson" insert --,--.

Abstract, Front Page, Line 2 delete "of".

Claim 4, Column 10, Line 21 change "or" to --of--.

Signed and Sealed this

Eleventh Day of April, 1995

Bruce Lehman

*Attest:*

BRUCE LEHMAN

*Attesting Officer*

*Commissioner of Patents and Trademarks*